United States Patent [19]

Plom et al.

[11] 4,014,376

[45] Mar. 29, 1977

[54] WINDOW BLINDS

[76] Inventors: Paul Plom; Jean-Paul Plom, both of Route Nationale 7, Pougues-les-Eaux 58320, France

[22] Filed: Dec. 15, 1975

[21] Appl. No.: 640,988

[52] U.S. Cl. ..... 160/172; 160/176

[51] Int. Cl.[2] ..... E06B 9/30

[58] Field of Search ..... 160/172, 176, 174, 175

[56] References Cited

UNITED STATES PATENTS

| | | | |
|---|---|---|---|
| 1,496,223 | 6/1924 | Hoffman | 160/172 |
| 2,167,840 | 8/1939 | Hepworth | 160/172 |
| 3,034,574 | 5/1962 | Gerold | 160/172 X |

*Primary Examiner*—Philip C. Kannan

*Attorney, Agent, or Firm*—Pollock, Vande Sande & Priddy

[57] ABSTRACT

A slatted window-blind construction in which the system for controlling the inclination of the slats comprises at least one group of rigid supporting elements each mounted to pivot about a swivelpin extending from the rectilinear edge associated with the groove of one of a group of thin elements to cooperate with an abutment extending from the free edge of the lower adjacent thin element, and a connecting means fastening the free ends of these supporting elements to one another to control simultaneously their pivoting and inclination and/or the mutual interconnection of the thin elements each time these latter are in an unfolded position.

8 Claims, 5 Drawing Figures

WINDOW BLINDS

The present invention is concerned with the construction of window-blinds with slats of variable inclination and which slats are preferably interconnected with one another.

In French Pat. No. 72.25083 filed July 11, 1972 in the name of Monsieur Paul Plom, it is proposed to provide a window-blind construction comprising similarly shaped thin elements each of which is in a pivotable and slidable relationship by one of its rectilinear edges to at least two parallel side grooves or guideways, a fastening system connecting to one another the rectilinear edges associated with the grooves of the different thin elements so as to allow regular unfolding of these latter starting from a position of storage where they are arranged adjacent each other, an operating system for controlling the unfolding and the storing of the thin elements, and an adjusting system connected to each of the free rectilinear edges of the different elements to control the inclination of these latter and/or their mutual interconnection when these elements are provided along the length of their rectilinear edges with two oppositely directed flanges.

While this construction is generally satisfactory, it has been established that in certain conditions (and notably with window-blinds of large dimensions) the mutual interconnecting arrangement of the thin elements (slats), which is the locking mechanism of the blind, is accomplished with difficulty.

The present invention provides a novel adjusting system allowing, with assurance, every time, an easy control and continuity of inclination of the thin elements and a complete mutual interconnection of these latter whatever the dimensions and/or the operating conditions of the window-blind construction.

According to the present invention there is provided a window-blind construction comprising similarly shaped thin elements, each of which is in a pivotable and slidable relationship by one of its opposed rectilinear edges to at least two parallel side grooves, a fastening system connecting to one another the rectilinear edges of the different thin elements associated with the grooves so as to allow regular unfolding of these latter starting from a position of storage where they are arranged adjacent each other, and an operating system controlling the unfolding and storing of the thin elements, and an adjusting system connected to each of the free remaining rectilinear edges of the different elements to control the inclination of these latter and/or their mutual interconnection when these elements are provided along the length of their rectilinear edges with two oppositely directed flanges, the adjusting system including at least one group of rigid supporting elements each mounted to pivot about a swivel pin extending from the rectilinear edge associated with the groove of one of the thin elements to cooperate with an abutment extending from the free edge of the lower adjacent thin element, and a connecting means fastening the free ends of these supporting elements to one another to control simultaneously their pivoting and inclination and/or the mutual interconnection of the thin elements each time these latter are in an unfolded position.

According to a preferred arrangement, the supporting elements are each constituted by a rod which is coiled to pivot at one of its ends on a corresponding pin and which is provided at its other and free end with a bent portion to which is fastened the connecting means.

In a modification, the bent portion is orientated towards the outside in an appreciably parallel direction to the rectilinear edges of the thin elements in order to cooperate with a turned portion extending from the abutment and lying appreciably in the general plane of the corresponding thin element so as to allow the inclination of the slope to be changed through a range greater than 90°.

An embodiment of the present invention will now be described, by way of example, with reference to the accompanying drawings, in which.

Figure 1:
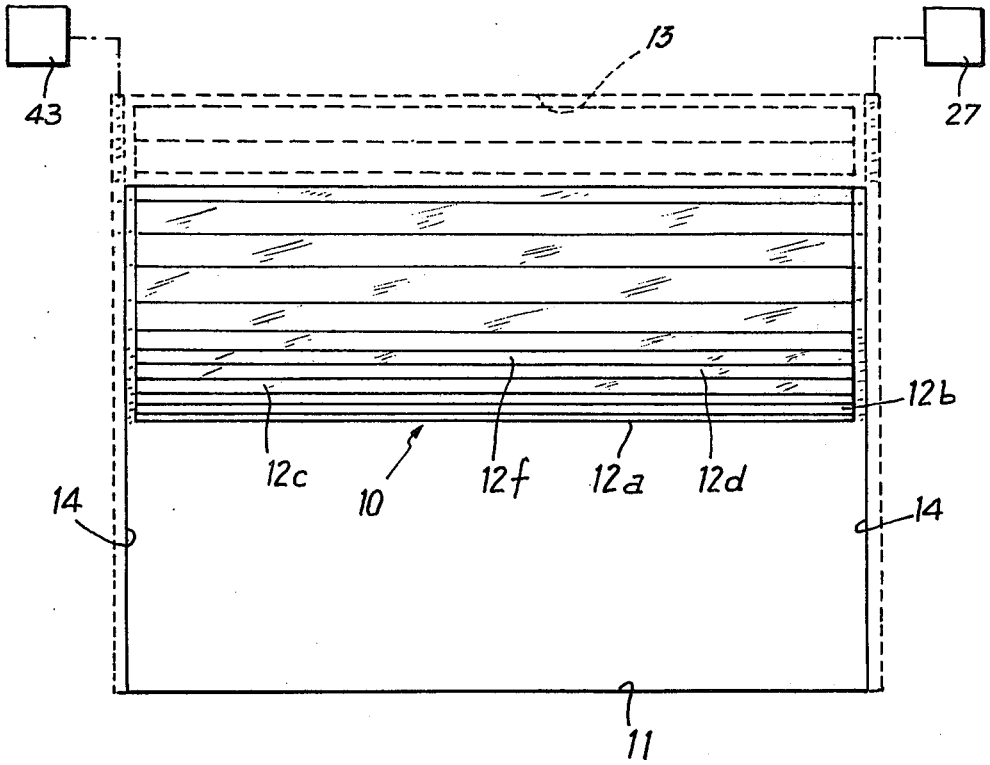
FIG. 1 is a schematic front view of a window-blind construction according to the invention.

In the drawings the reference 10 generally designates a window-blind construction intended to close a window bay or similar opening 11 as found in a dwelling or the like.

Figure 3:
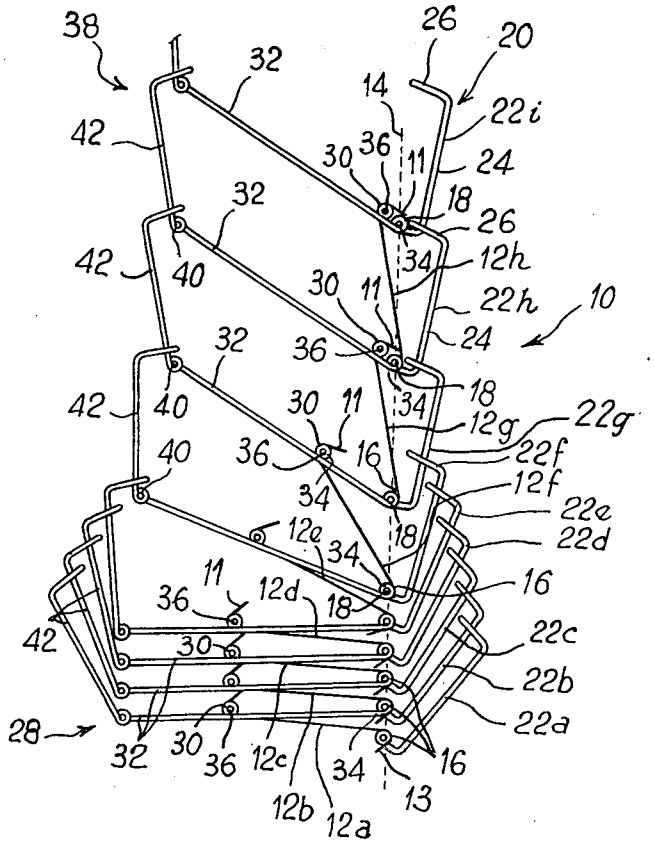
FIG. 3 is a view similar to FIG. 2 showing the unfolding of the window-blind construction according to the invention in the locked position of the slats.

The construction 10 is essentially composed of a plurality of similarly shaped thin elements 12*a*, 12*b*, 12*c* . . . such as thin strips of wood, light alloys or rigid synthetic material which are intended to be unfolded along the length of parallel side grooves 14 suitably fixed to the stiles of the opening which is to be closed (or possibly fixed to an intermediate movable stile in the case of an opening of large dimensions). In the stored position, the slats are stacked on top of one another (as shown in FIGS. 1 to 3) and are arranged in a framework 13 at the top or bottom of the opening 11.

With a view to the unfolding starting from this stored position, each slat 12 is slidably mounted, with the possibility of pivotal movement along its outer rectilinear edges, in grooves or slideways 14. When there are only two side grooves 14, the ends of the edge 16 of each slat can be extended to provide a swivel or similar pin 18 adapted to cooperate slidably and pivotably with the corresponding groove 14. The edge 16 of each slat 12 can also, when the number of grooves 14 is greater than two, be fitted with a required number of corresponding runners, pivotally fixed in requisite position to the slat in question and slidably positioned in the adjoining side groove.

Moreover, the slats 12*a*, 12*b*, 12*c* . . . are fastened to one another at their edge 16 by means of a suitable fastening means 20 adapted to allow, on the one hand, slats to be stored one above another with as small a space as possible between the slats and to maintain, on the other hand, a predetermined constant space between the edges 16 of successive slats 12*a*, 12*b*, 12*c* . . . so that when the latter are unfolded it is possible to pivot each slat around its edge 16. In one possible arrangement, the fastening means 20 is simply made up of two or more strips or similar non-extensible flexible bands such as straps fixed at regular intervals by any suitable means to the different successive slats 12 of the construction 10. In the embodiment shown, the fastening means 20 is constituted by two connecting devices fitted respectively to the ends of the slats 12 and each constituted by a chain with sliding hinged links 22 of the type disclosed in French Pat. No. 72.25083 filed July 11, 1972 in the name of Monsieur Paul Plom. This patent can be referred to for all details of the structure and function of the link chain 22. It is sufficient for the understanding of the present invention to know that each of the links 22*a*, 22*b*, 22*c* of the chain is in the general shape of an L and is linked by its large limb 24 to the end of the edge 16 of the corresponding slat 12 (or better still to the swivel pin 18) and slidingly cooperates via its small limb 26 with the large limb 24 of the preceding link.

Figure 2:
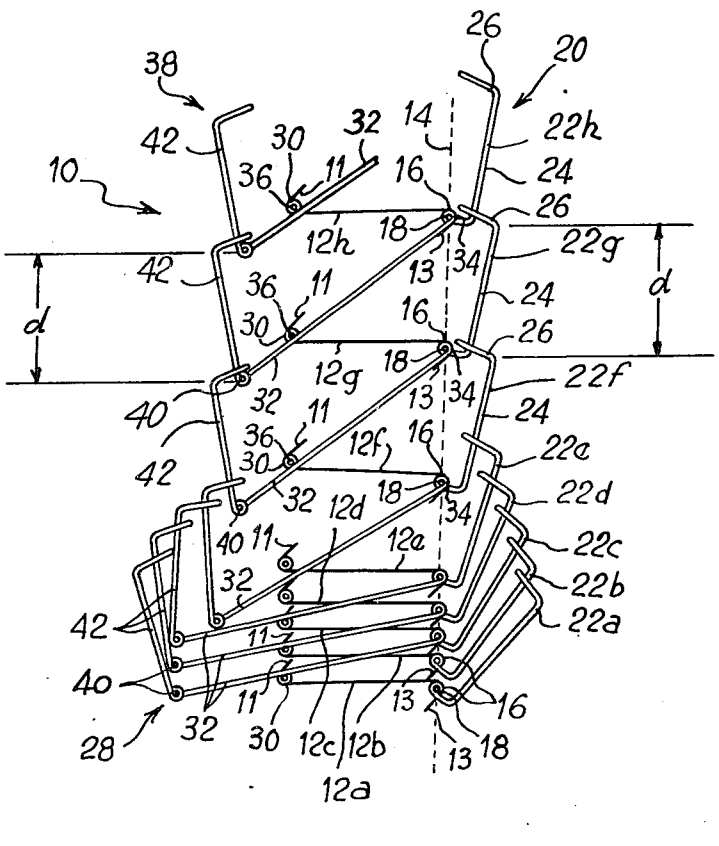
FIG. 2 is a schematic end view illustrating the unfolding of the window-blind construction according to the invention in which the position of the slats is as a "venetian blind"

An operating apparatus, indicated schematically by 27 in FIG. 1, of any known appropriate type, such as a chain operated by a manual or assisted winch, is provided to effect the unfolding and the storing operations of the construction 10. These operations amount to controlling the descent and ascent of the slats from the lowest slat 12*a* of the construction (stored above the opening) to the highest slat (stored below the opening).

With a view to controlling the inclination of each slat 12 about its edge 16, the invention proposes an adjusting system 28 for acting upon the free edges 30 of the slats 12 in the general direction of the grooves so as to control the pivoting of the slats 12*a*, 12*b*, 12*c* . . . in relation to the latter. This system 28 is essentially constituted by, on the one hand, a plurality of rigid supporting elements, such as metal rods 32, each of which is coiled as at 34 to pivot around a pin, such as the swivel pin 18 and extending from the edge 16 of the corresponding slat in order to cooperate with an abutment, such as a pin 36, extending from the free edge 30 of the lower adjacent slat. The adjusting system is completed, on the other hand, by connecting and entrainment means 38 adapted to fasten together with fixed spacing *d* the free ends of the rods 32 which ends are shaped with a bent portion 40.

Figure 4:
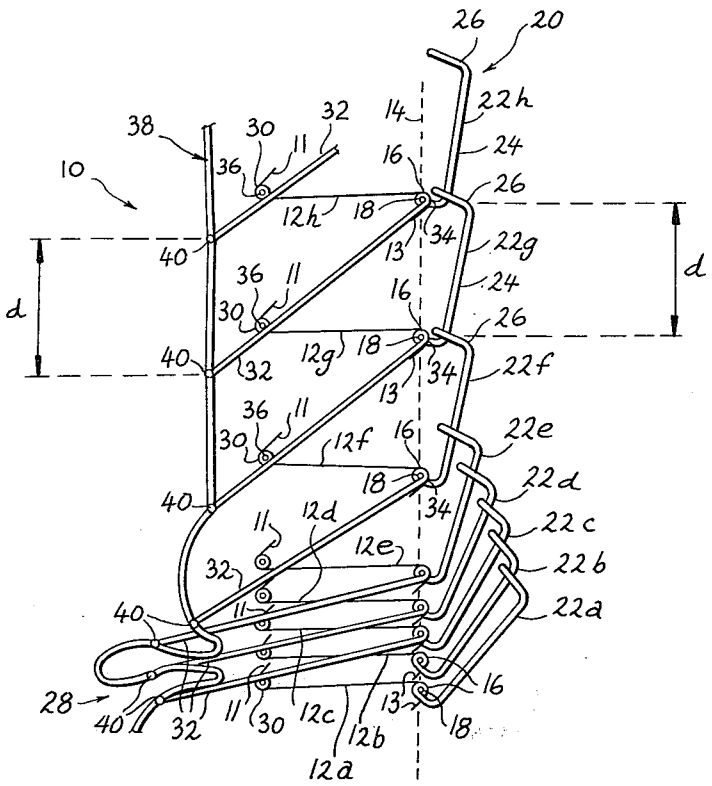
FIG. 4 is a view similar to FIG. 2 showing a modification of the connecting means.

The connecting means 38, like the fastening system 20, must permit the storage of some of the slats and associated rods 32 at the same time as the unfolding of the structure by maintaining between the bent ends 40 of two adjacent rods a separation *d* equal to that between the edges 16 of two adjacent slats. It can, for example, be constituted by a flexible band such as a strap fixed hole by hole to the ends 40 of the rods 32 (FIG. 4). It can also be constituted, as shown, by a chain with sliding hinged links 42 of the type described in the aforementioned French patent in which each link 42 is hinged to the corresponding end 40 and slidingly cooperates with the preceding link.

This has the advantage of positioning an adjusting system 28 at each end of the slats 12, which can be operated by a common controlling means 43. The function of the adjusting system or systems 28 is as follows. If one supposes that the slats are unfolded into the position of a "Venetian" blind as illustrated by the slats 12*c*, 12*d*, 12*f*, in FIG. 1, it is evident that the inclination of the rods 32, on which the abutments 36 are supported, controls the inclination of the slats in relation to the grooves. Thus,if the ends 40 are pulled upwards, with the help of the controlling means 43 and by the connecting means 38, the unfolded slats pivot about their edges 16 so as to cover more of the opening 11. The slats 12*e* and 12*f* in FIG. 2 show two intermediate positions between the "Venetian blind" position of the slats unfolded as in FIG. 1 and the position of complete coverage by the slats 12*g* and 12*h* in FIG. 2.

If, as shown, the slats 12 are advantageously fastened together and, to this end, include oppositely-directed flanges 11 and 13, it is clear that pivoting of the rods 32 allows the necessary uplifting of the slats by their mutual interconnection. This interconnection is effected, moreover, from top to bottom, the highest slats having an inclination with respect to the grooves greater than that of the lower slats. It should be apparent that the rods 32 are adapted in their "high" position substantially parallel to the grooves 14 to maintain the slats in an interconnected position, in order to lock the shutter construction 10 thus constituted, by preventing the slats from vibrating. This applies equally in the case of simple non-interconnected slats. It is equally necessary to observe that the guiding of the abutments 36 by the rods 32 allows a slat to avoid sliding on another at the level of their cooperating oppositely directed flanges 11 and 13 respectively when they are interconnected.

In order to allow unlocking of the interconnected slats, it is sufficient to loosen the connecting means 38 so that the rods 32 are made to swivel towards their "low" position shown in the upper part of FIG. 1. The unlocking of the slats is then automatically effected from top to bottom. In effect, the pivoting in the "Venetian blind" position of the highest slat allows the sequential unlocking of the following slats which pivot in their turn.

In the same way, when the slats are in a "Venetian blind" position, it is sufficient to make the rods 32 pivot towards the top to lock the slats in an interconnected position.

Of course, the locking of the slats 12 can be automatically effected at the time of the unfolding of the construction 10 starting from the stored position, as is shown in FIG. 2.

In the arrangement described above, the bent ends 40 of the rods 32 are directed towards the slats, i.e., towards the inside of the construction 10, in order to be joined by the connecting means 38. The pivoting of the slats 12 is thus limited by the length of the rods 32, the maximum "opening" position of the slats being obtained when each abutment 36 traverses the length of the associated rod 32. The pivoting angle of the slats 12, in the example shown, is limited to a value slightly more than 90°.

Figure 5:
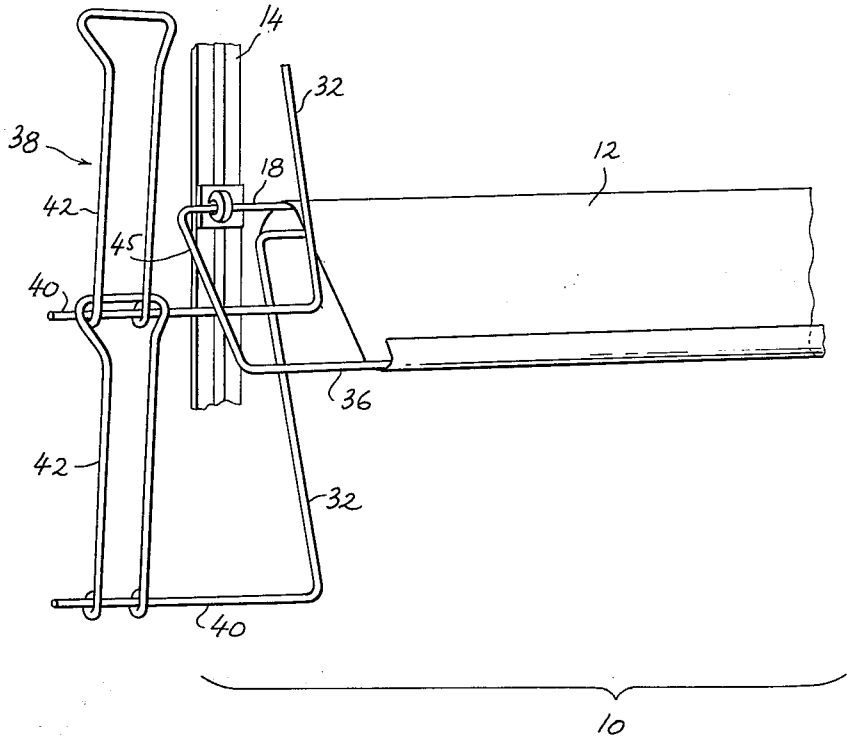
FIG. 5 is a detailed perspective view of a modification of the slat mounting structure.

In a variation (shown in FIG. 5), the bent ends 40 of the rods 32 are oriented towards the outside of the construction 10 and the abutments 36 each comprise a bent extension 45 which forms a turned portion lying appreciably in the plane of the corresponding slat 12 towards the swivel pin of the latter. The sliding cooperation of the bent portion 45 towards the outside 40 of the turn allows an advantageously slackening of the connecting means 38 towards the bottom, the pivoting of the slats 12 to be increased in relation to the grooves 14.

It is possible to provide an auxiliary attachment system for the free edges 30 of the slats 12 similar to system 20. This supplementary system permits an interlocking of the slats notably conferring a better resistance against the wind.

It is to be understood that the invention is not limited to the described and illustrated embodiment. A number of modifications can be made to it. In particular, the number and the shape of the grooves 14, the construction particularly of the attaching system 20 and the connecting means 38, the shape and the configuration of the rigid supports 32 and abutment 36 as well as the composition of the slats 12, can be different from that which has been described above, so that the structure can be adapted to different forms of shuttering, without departing from the scope of the claimed invention. Equally it will be understood that the side grooves 14 do not have to be either vertical (they may be inclined towards the horizontal) or even rectilinear (curved portions may be introduced) so as to lend themselves to different forms of opening or window bay.

What we claim is:

1. Window blind construction comprising similarly shaped thin elements, each of which is in a pivotable and slidable relationship by one of its opposed rectilinear edges to at least two parallel side grooves, a fastening system connecting to one another the rectilinear edges of the different thin elements associated with the grooves so as to allow regular unfolding of these latter starting from a position of storage where they are arranged adjacent each other, and an operating system controlling the unfolding and storing of the thin elements, and an adjusting system connected to each of the free remaining rectilinear edges of the different elements to control the inclination of these latter and/or their mutual interconnection when these elements are provided along the length of their rectilinear edges with two oppositely directed flanges, the adjusting system including at least one group of rigid supporting elements each mounted to pivot about a swivel pin extending from the rectilinear edge associated with the groove of one of the thin elements to cooperate with an abutment extending from the free edge of the lower adjacent thin element, and a connecting means fastening the free ends of these supporting elements to one another to control simultaneously their pivoting and inclination and/or the mutual interconnection of the thin elements each time these latter are in an unfolded position.

2. Window blind construction according to claim 1, in which each supporting element is constituted by a rod which is coiled to pivot at one of its ends on a corresponding pin and which is provided at its other free remaining end with a bent portion to which is fastened the connecting means.

3. Window blind construction according to claim 2, in which the bent portion is oriented towards the outside in a substantially parallel direction to the rectilinear edges of the thin elements in order to cooperate with a turned portion extending from the abutment and lying substantially in the general plane of the corresponding thin element so as to allow the inclination of the slope to be changed through a range greater than 90°.

4. Window blind construction according to claim 1, in which the connecting means is constituted by a flexible strap.

5. Window blind construction according to claim 1, in which the connecting means is constituted by a chain with sliding hinged links, each link connecting the supporting element of a thin element with the corresponding link to the supporting element of a preceding thin element.

6. Window blind structure according to claim 1 in which the fastening system comprises two connecting devices each joining to one another the aforesaid pins situated at each side of the thin elements.

7. Window blind structure according to claim 6, in which at least one of the connecting devices is constituted by a flexible band.

8. Window blind structure according to claim 6, in which each connecting device is constituted by a chain with sliding hinged links, each link joining the pin of a thin element with a corresponding link to the pin of the preceding thin element.

* * * * *